US006976375B2

(12) United States Patent
Minix

(10) Patent No.: US 6,976,375 B2
(45) Date of Patent: Dec. 20, 2005

(54) DOOR LATCH WITH ADJUSTABLE LATCH ELEMENT

(75) Inventor: Rich Minix, Elkhart, IN (US)

(73) Assignee: Fastec Industrial Corp., Elkhart, IN (US)

( * ) Notice: Subject to any disclaimer, the term of this patent is extended or adjusted under 35 U.S.C. 154(b) by 0 days.

(21) Appl. No.: 10/850,111

(22) Filed: May 21, 2004

(65) Prior Publication Data

US 2005/0257582 A1 Nov. 24, 2005

(51) Int. Cl.[7] ..... E05B 13/10

(52) U.S. Cl. ..... 70/208; 70/224; 70/461; 292/194; 292/DIG. 31; 292/DIG. 60

(58) Field of Search ..... 70/208–211, 224, 70/303 A, 333 R, 379 R, 380, 461; 292/194, 292/197, 202–204, 226, 228, 207, DIG. 31, 292/358–359, DIG. 60

(56) References Cited

U.S. PATENT DOCUMENTS 1,652,660 A * 12/1927 Devereaux ..... 70/210
4,370,874 A * 2/1983 Munn ..... 70/211
4,438,964 A * 3/1984 Peters ..... 70/208
4,671,547 A * 6/1987 Weinerman et al. ..... 292/197
4,706,478 A * 11/1987 Swan et al. ..... 70/210
5,076,080 A * 12/1991 Fuss et al. ..... 70/208
5,526,660 A * 6/1996 Bennett et al. ..... 70/208
5,913,908 A * 6/1999 Czipri ..... 70/208
6,418,761 B1 * 7/2002 Wytcherley et al. ..... 70/208
6,454,321 B1 * 9/2002 Parikh ..... 70/208
6,502,868 B1 * 1/2003 Laspa et al. ..... 292/48
6,530,250 B1 * 3/2003 Linares et al. ..... 70/208
6,651,467 B1 * 11/2003 Weinerman et al. ..... 70/208
6,666,053 B2 * 12/2003 Sadler ..... 70/210
6,668,602 B2 * 12/2003 Graham et al. ..... 70/208

* cited by examiner

*Primary Examiner*—Brian E. Glessner
*Assistant Examiner*—Christopher Boswell
(74) *Attorney, Agent, or Firm*—Dykema Gossett PLLC

(57) ABSTRACT

A door latch includes pan or attachment to a flat surface of a door adjacent a door frame; an actuation subassembly which includes a handle on one side of the pan, a turn cam on an opposite side of the pan and a handle shaft which connects the handle with the turn cam through a hole in the pan, the turn cam including two rectilinear members extending in parallel with the handle shaft and away from the pan; and a latch subassembly which includes a latch element having a latch body with holes therein through which the rectilinear members extend and a latch arm, and an adjustment member to which the latch element is rotatably attached, the adjustment member moving the latch element toward and away from the pan and to adjust its positioning relative to the pan.

20 Claims, 4 Drawing Sheets

DOOR LATCH WITH ADJUSTABLE LATCH ELEMENT

BACKGROUND OF THE INVENTION

1. Field of the Invention

The present invention relates to door latches, and in particular to door latches wherein the latch element can be adjusted in positioning (depth) relative its pan or face plate.

2. The Prior Art

Door latches having latch elements which can be adjusted in position, i.e., adjusted in distance (depth) between it and the latch pan so as to properly cooperate with a strike plate on a door frame, are known. However, in known door latches the mechanics for achieving the adjustment are quite cumbersome and generally involve adjusting two nuts on opposite sides of the latch element, which is positioned on a handle shaft (see, for example, U.S. Pat. Nos. 4,706,478 and 6,530,250). Both nuts must be rotated to readjust the positioning of the latch element along the handle shaft, which is very awkward insofar as only a small space may be available between the nut located closest to the pan and the pan itself. Once the latch is installed in a door, this nut can be almost impossible to reach.

A need exists for a door latch wherein its latch element can be easily and readily adjusted in position (depth) relative to the pan both during and after installation.

SUMMARY OF THE INVENTION

According to the present invention a door latch having an easily adjustable latch element includes a pan; an actuation subassembly which includes a handle on a first (outer) side of the pan for manual gripping and turning, and a handle shaft that extends through a pan hole and is rotatable by the handle. The door latch also includes a latch subassembly that includes a latch bracket defining a hole aligned with the pan hole in the pan, an adjustment member which is collinear with the handle shaft and can be moved in parallel with the handle shaft toward and away from pan, and a latch element mounted on the adjustment member so as to move with it towards and away from the turn cam and thus change its distance from the pan.

In a preferred embodiment the actuation subassembly includes a turn cam connected to the handle shaft for rotation of the latch element. The turn cam can include rectilinear members which extend in parallel with the handle shaft in a direction opposite the pan. The latch element can include a latch body having turn holes through which the rectilinear members extend and a latch arm, the rotation of the handle and turn cam causing the latch element to rotate around the adjustment member between a latched and an unlatched state. The depth of the latch element can be easily adjusted by manipulating the adjustment member from a side opposite the pan, which is easy to access. The adjustment member is preferably a threaded bolt.

In a further preferred embodiment of the invention the handle of the actuation subassembly is a T-handle which is pivotally attached to the handle shaft and is pivotable between a lowered position and a raised position. The pan preferably includes a recess in which the pan and T-handle, when in a lowered position, is contained.

In another preferred embodiment of the invention the door latch includes a locking subassembly which includes a slide bar that can interact with the turn cam to prevent its rotation and thereby lock the latch element in a latched state, or allow its rotation and thereby enable the latch element to be rotated from its latch state to its unlatch state and visa versa.

A better understanding of the invention will be had by reference to the attached drawings, taken in conjunction with the following discussion.

DETAILED DESCRIPTION OF THE PREFERRED EMBODIMENTS

Figure 1:
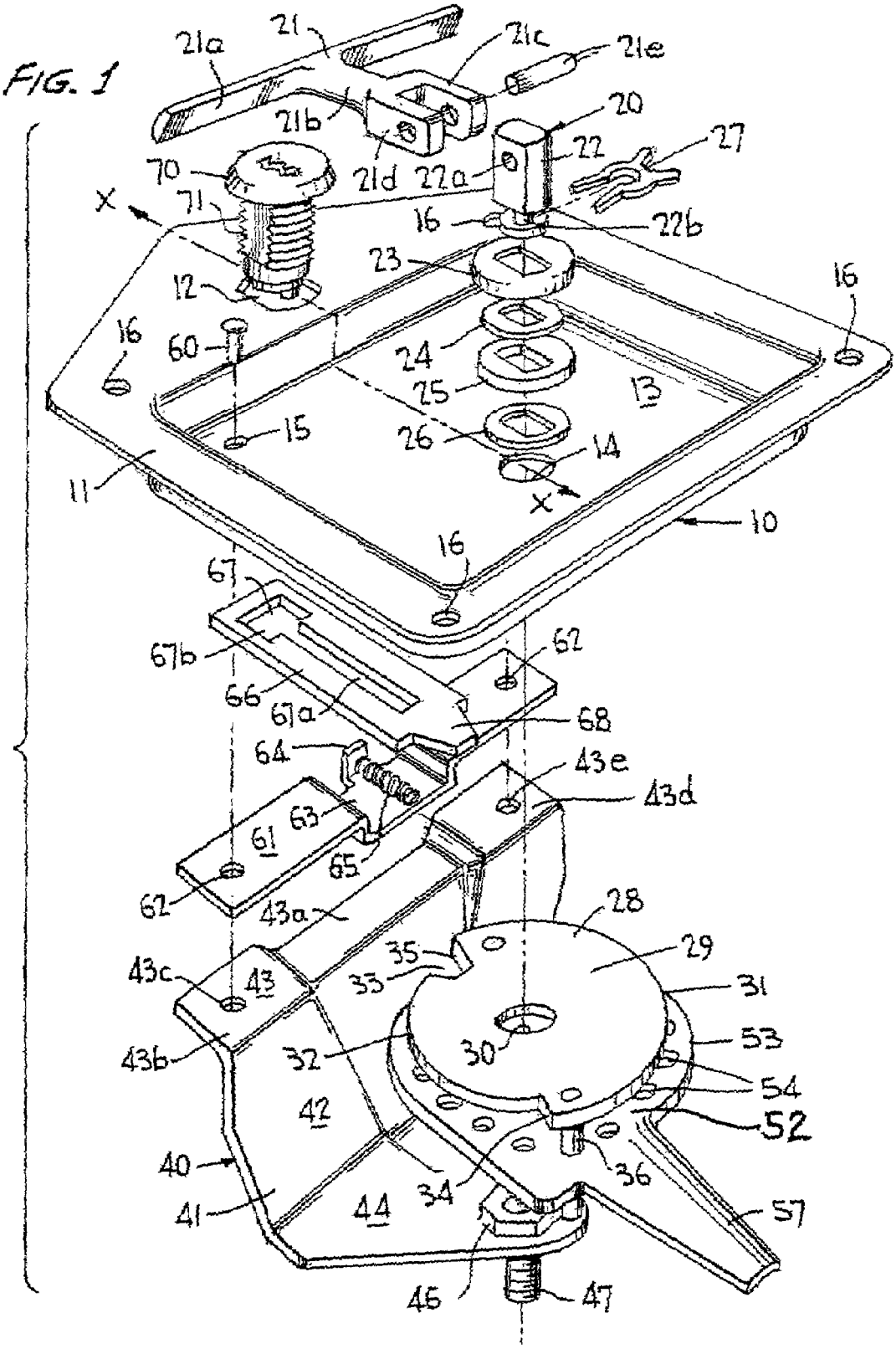
FIG. 1 is an exploded, top perspective view of a door latch according to a preferred embodiment of the present invention, this embodiment including a pivotal T-handle (shown in a lowered orientation) and a locking subassembly for locking the door latch in a latched state, its latch element being depicted in an extended (latched) position.

FIG. 1 show as an exploded view of a door latch according to a preferred embodiment of the invention. It includes a pan 10, an actuation subassembly 20, a latch subassembly 40, and a locking subassembly 60.

The pan 10 includes a generally flat face plate 11 having a generally rectangular recess 13 formed therein. The face plate 11 includes a slot 12 that is centered on an imaginary center line X—X. The pan includes a pan opening 14 that is also centered on the line X—X. The slot 12 enables the body of a cylinder lock of the locking subassembly 70 to extend through the pan while a handle shaft 22 of actuation subassembly 20 extends through pan opening 14. Holes 15 are provided in the corners of recess 13 nearest the slot 12 for rivets 60 of the latch subassembly 50 (only one of the holes 15 is shown). Holes 16 are provided in the face plate 11 to enable the pan to be attached to a flat surface of a door (not shown) adjacent a strike plate in a door frame. The pan 10 is preferably made of metal such as steel or aluminum.

The actuation assembly 20 includes a T-handle 21 having a grip bar 21*a*, a shank 21*b* and a U-shaped base 21*c* whose arms include aligned holes for a pivot pin 21*d* that can connect the T-handle to a handle shaft 22. The handle shaft 22 includes a bore 22*a* through one end (through which the pivot pin 21*d* extends) and an annular slot 22*b* near its opposite end, and it is sized to fit through opening 14 with a minimum of play. Positioned around the handle shaft 22 between the bore 22*d* and the recess 13 are a collar 23, a first metal washer 24, a rubber washer 25 and a second metal washer 26. The rubber washer 25 will cause the collar 23 to press against the U-shaped base 21*c* of the T-handle 21 to bias it in either a lowered position or a raised position as will be referred to again below.

Figure 2:
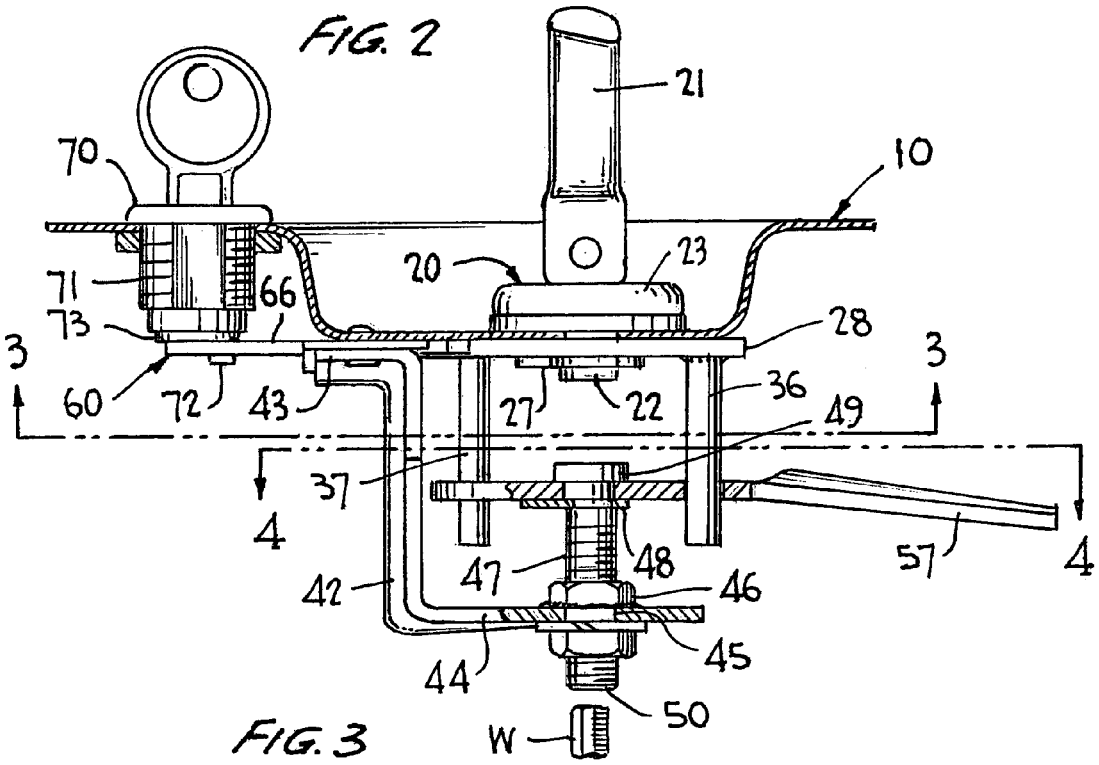
FIG. 2 is a side elevational view of the door latch of FIG. 1 when locked, its T-handle being depicted in a raised orientation.
Figure 3:
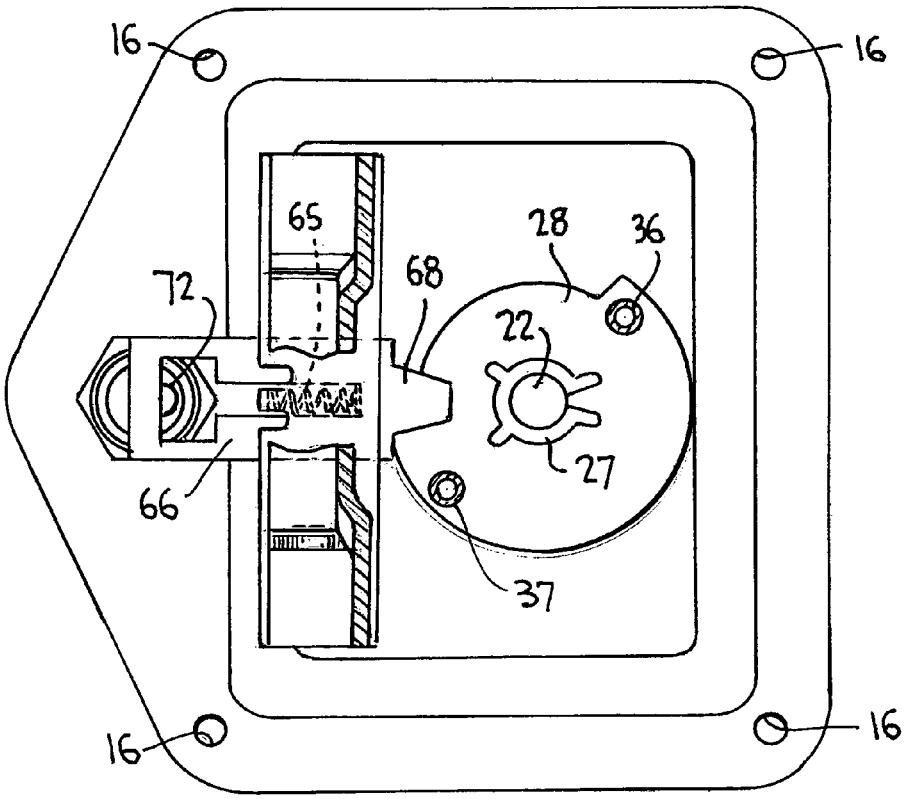
FIGS. 3 and 4 are cross sections of the door latch of FIG. 2 as respectively seen along lines 3—3 and 4—4 therein.

The actuation assembly also includes a turn cam 28 on the opposite side of plan 10 from the T-handle 21 which includes a generally flat head 29 having an opening 30 therein and two rectilinear members 36 and 37 extending from the head in parallel with the handle shaft 22 and in a direction opposite the pan 10. The members 36 and 37 are located on opposite sides of the opening 30. The handle shaft 22 extends through the opening 30 and the head 29 and is axially positioned on the handle shaft by spring clip 27 locked on the handle shaft at annular slot 22*b*. The head 29 is rotatable with the handle shaft because its opening 30 corresponds in shape to the non-cylindrical shape of the handle shaft. The spacing between the bore 22*a* and the annular slot 22*b* is such that the rubber washer 25 presses collar 23 against the U-shaped base 21*c* of T-handle 21 but allows pivoting of the T-handle between a lowered position (FIG. 1) and a raised position (FIG. 2). The arms of the U-shaped base 21*c* have generally flat sides and bottoms with rounded corners therebetween to facilitate pivotable movement between, and biased placement at, raised and lowered orientations.

The head 29 of the turn cam 28 includes a first edge portion 31 which is generally circular and a second edge portion 32 which is also generally circular, the radius of the second edge portion being smaller than that of the first edge portion such that abutment surfaces 34 and 35 are formed therebetween. In addition, a cutout 33 is formed in the second edge portion adjacent abutment surface 35 to accept the head of a slide bar of the locking subassembly 70 as will be discussed below.

The latch subassembly 40 includes a generally z-shaped bracket 41 that includes a main body 42, a first flange 43 which extends away from one end of main body 42 and a second flange 44 which extends away from a second end of main body 42 in a direction opposite to the first flange 43. As best seen in FIG. 1, the first flange 43 includes a central recessed area 43*a* that provides pods 43*b* and 43*d* at its opposite ends, these pods defining holes 43C and 43*e*. Rivets 60 extend through holes 15 in pan 13 and the holes 43*c* and 43*e* to fixedly attached the bracket 41 to the pan 10 (only one rivet 60 is shown in FIG. 1). The second flange 44 includes a hole 45 which is aligned with the opening 14 in the pan 13. A threaded guide element, shown as a nut 46, is fixedly attached to the second flange 44 and aligned with the hole 45 and the pan 13. An adjustment bolt 47 having an annular slot 48 beneath a head 49 threadingly extends through the guide element 46 so that rotation thereof relative to the guide element will move its head 49 to move toward and away from the pan 13. The adjustment bolt 47 includes means in the form of a blind bore 50 at its end opposite head 49 to enable it to be rotated using a suitable tool, such as an Allen wrench W. A lock nut 51 with integral lock washer will lock rotational positioning of adjustment bolt 47 in guide element 46 when tightened against the second flange 44.

Figure 4:
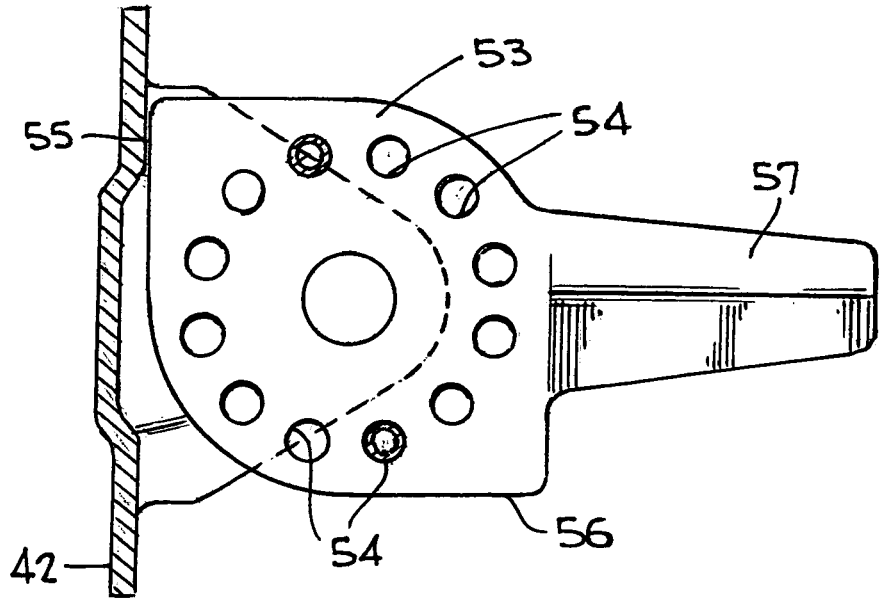
Figure 5:
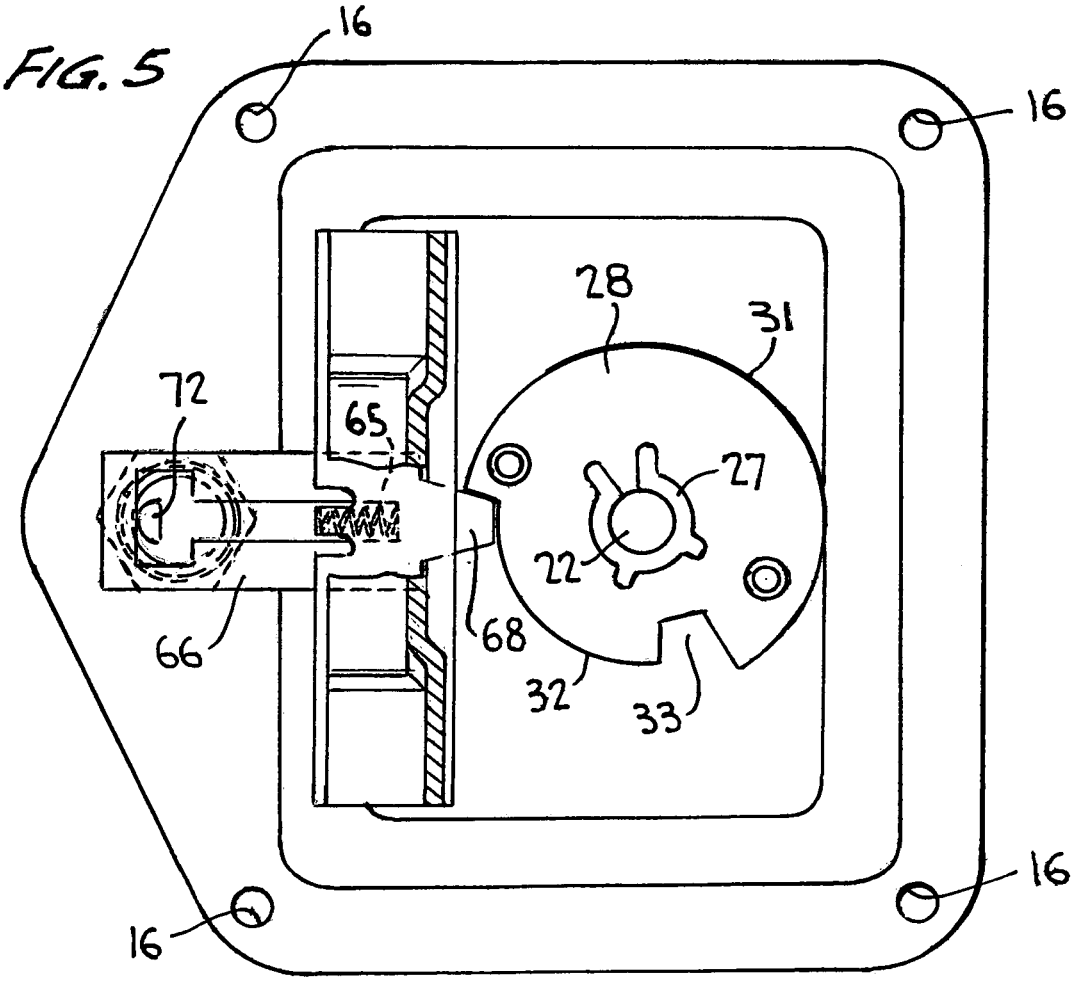
FIGS. 5 and 6 are cross sections similar to FIGS. 3 and 4 when unlocked and its latch element has been rotated to a retracted (unlatched) position.
Figure 6:
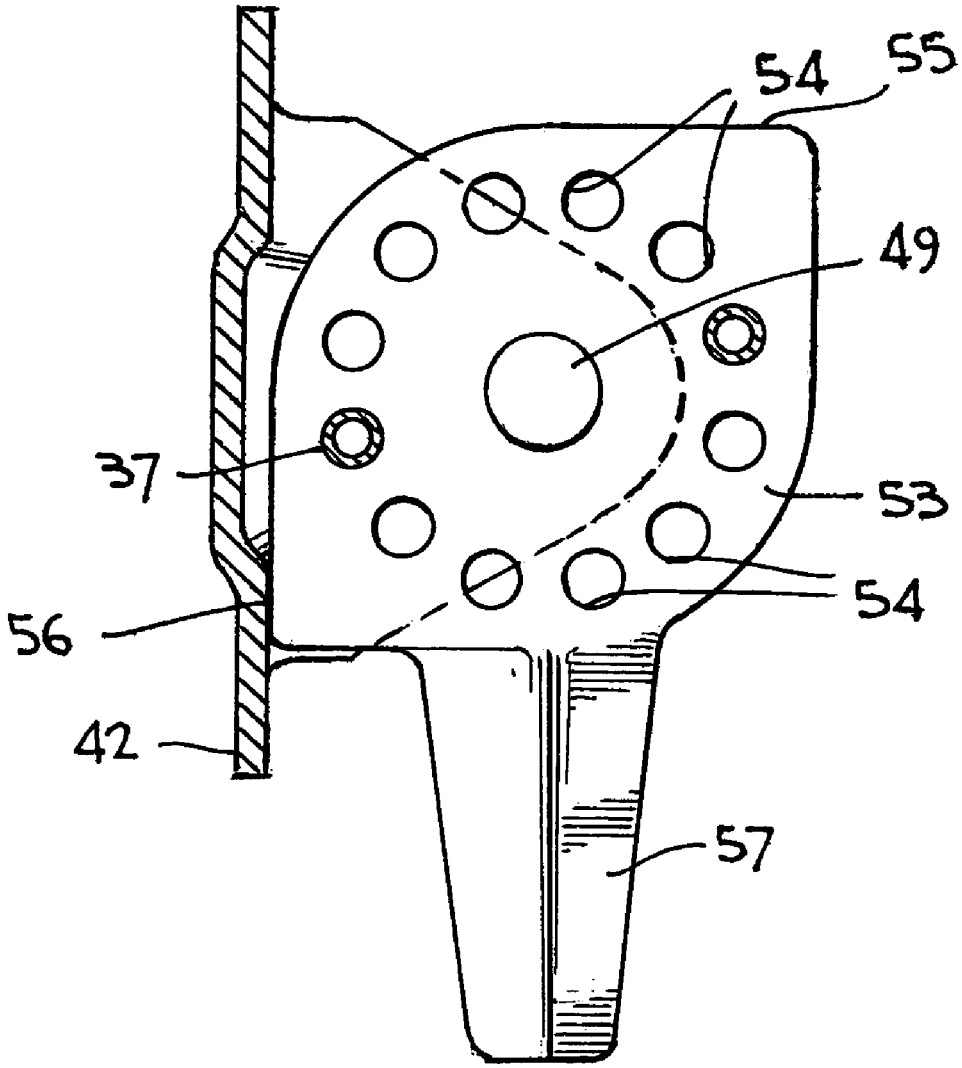

The latch subassembly also includes a latch element 52 which has a latch body 53 and latch arm 57 that extends away from the body. The latch body 53 includes a central hole (not labeled) which is positioned around the adjustment bolt 47 beneath its head 49 and axially retained in position relative to head 49 by a spring clip 58. The latch body 53 also includes an even number of equally spaced turn holes 54 positioned in a circular pattern around the central hole, the distance between diagonally positioned turn hole pairs being equal to the distance between the rods 36, 37 of the actuation subassembly and sized to be slightly greater in diameter than the diameter of the rods. As a result, the latch element can move along the rods as the adjustment bolt 47 is moved toward and way from pan 10, yet will rotate relative to the adjustment bolt when the turn cam 28 is rotated. Rotation of the latch element due to rotation of the turn cam will cause the latch arm 55 to rotate from a latched (extended) positioning (FIG. 1) to an unlatched (retracted) positioning (FIG. 6). The edge of the latch body includes abutment surfaces 55 and 56 which can contact the main body 42 of bracket 41 to restrict rotational movement of the latch element (see FIGS. 4 and 6). Turn holes 54 other than those containing rods 36, 37 can be used to move connectors extending to additional latches (not shown) which are actuated by movement of the latch element.

Thus, in order to easily adjust the depth positioning of the latch element 52 relative to pan 10, the lock nut 51 is loosened and the adjustment bolt 47 is turned (perhaps using wrench W), thus moving the latch body 53 along the rods 36 and 37 to the desired positioning. The lock nut 51 is then tightened against the flange 44 of the bracket 41. The process is quick and easy. The latch element is thereafter rotatable around the adjustment bolt by rotation of the turn cam 28 when rotated by the T-handle 21.

Turning now to the locking subassembly 60, it includes a bracket 61 which is located between the recess 13 and the flange 43 of bracket 41 and retained in position by rivets 60 extending through holes 62. The bracket 61 defines a slide channel 63 having a detent 64 which backs a spring 65. A slide bar 66 having a T-slot 67 therein is positioned in the slide channel 63 so as to slide toward and away from the second edge portion 32 of head 29 of turn cam 28, the detent 64 fitting within the main channel 67*a* of T-slot 67. The end of slide bar 66 defines a projection 68 that fits within the indent 33 of the head 29. Spring 65 abuts the bottom of main channel 67*a* to bias the side bar 66 towards the head 29.

A key-operated cylinder lock 70 having a body 71 extends through slot 12 in face plate 11 of pan 10 is fixedly attached to the face plate, and an offset lug 72 extending from the bottom of its rotatable cylinder 73 fits within the cross channel 67*b* of T-slot 67 so that rotation of the lug 72 due to rotation of the cylinder 71 will either cause the slide bar 66 to move away from the head 29 to an unlocked position (its projection 68 withdrawn from indent 33) or enable the spring 65 to move the projection against the second edge portion 32 and into the cutout 33 when the latch element is rotated to its latched position.

Although a preferred embodiment of the invention has now been described in detail, modifications there can be made and still fall within the scope of the appended claims.

I claim:

1. A door latch having a depth-adjustable latch element which comprises:

a pan which is attachable to a flat surface adjacent a doorway, said pan defining a pan hole therein, an actuation subassembly which includes a handle on one side of said pan and a handle shaft that extends through said pan hole, and a latch subassembly which includes a bracket defining a latch bracket hole aligned with said pan hole, an elongated adjustment member which is spaced away from said handle shaft and extends through said latch bracket hole so as to be collinear with said handle shaft, said adjustment member being movable toward and away from said handle shaft and said pan, and a rotatable latch element mounted on said adjustment member so as to be movable with said adjustment member towards and away from said pan, rotation of said handle shaft by said handle causing rotation of said latch element between a latched positioning and an unlatched positioning relative to said doorway.

2. A door latch according to claim 1, wherein said actuation subassembly includes a turn cam connected to said handle shaft on a side of said pan opposite said handle, rotation of said turn cam causing rotation of said latch element.

3. Door latch according to claim 2, wherein said elongated adjustment member comprises a threaded bolt.

4. A door latch according to claim 3, including an internally threaded guide element attached to said bracket and through which said threaded bolt extends.

5. A door latch according to claim 4, including lock means to fixedly position said threaded bolt relative to said guide element.

6. A door latch according to claim 5, wherein said lock means comprises a lock nut.

7. A door latch according to claim 3, wherein said threaded bolt includes means at an end thereof opposite said pan to facilitate manual rotation thereof.

8. A door latch according to claim 7, wherein said means comprises a configured blind bore therein for positioning of an Allen wrench.

9. A door latch according to claim 2, wherein said latch element includes a latch body and a latch arm, said latch body having a center hole therein for positioning around said adjustment member and a turn hole, and wherein said turn cam includes a rectilinear member which can freely extend through said turn hole to rotate said latch element about said center hole.

10. A door latch according to claim 9, including a plurality of turn holes in said latch body positioned in a circular arc around said center hole.

11. A door latch according to claim 10, wherein said turn cam includes a flat head and two rectilinear members which extend from said flat head in a direction opposite to said pan and through respective turn holes in said latch body.

12. A door latch according to claim 11, wherein said rectilinear members comprise cylindrical rods.

13. A door latch according to claim 11, wherein said head defines a first edge portion which extends along a first circular arc, and a second edge portion which extends along a second circular arc; a radius of said second circular arc being smaller than a radius of said first circular arc to define first and second abutment surfaces therebetween.

14. A door latch according to claim 13, wherein said second edge portion includes a cutout adjacent said second abutment surface.

15. A door latch according to claim 14, including a locking subassembly which includes a slide bar which can slide toward and away from said head of said turn cam and which defines a projection at one end thereof that can fit within said cutout in said second edge portion of said head to prevent rotation thereof and lock said latch element in a latched positioning.

16. A door latch according to claim 15, wherein said locking subassembly includes a lock bracket which is positioned between said latch bracket of said latch subassembly and said pan and which defines a slide channel in which said slide bar slides.

17. A door latch according to claim 16, wherein said pan includes a slot therein and said locking subassembly includes a key-operated cylinder lock which extends through said slot and includes a rotatable cylinder having an offset lug that can move said slide bar away from said cutout in said turn cam.

18. A door latch according to claim 17, wherein said slide bar includes a T-slot therein, wherein said bracket of said locking subassembly includes a detent that fits within a base channel of said T-slot, and including a spring positioned between said detent and a bottom said base channel to bias said slide bar towards said second edge portion of said head.

19. A door latch according to claim 18, wherein said offset lug of said cylinder lock extends in a cross channel of said T-slot.

20. A door latch according to claim 9, wherein said latch body includes a peripheral edge providing first and second abutment surfaces that can contact said latch bracket when said latch element is respectively in said latched positioning and unlatched positioning.

* * * * *